US005495799A

United States Patent [19]

Daniel

[11] Patent Number: 5,495,799

[45] Date of Patent: Mar. 5, 1996

[54] PRINTING PLATE WITH A MESH LAYER FORMING PIGMENT STORING WELLS

[76] Inventor: Jonathan R. Daniel, 48 Eastview Ct., Jericho, N.Y. 11753

[21] Appl. No.: 272,684

[22] Filed: Jul. 8, 1994

[51] Int. Cl.[6] ..... B41L 7/00; B41F 3/36

[52] U.S. Cl. ..... 101/150; 101/158; 101/395; 101/468; 101/472

[58] Field of Search ..... 101/114, 127, 101/128.21, 128.4, 150, 153, 158, 163, 395, 468, 472, 473; 434/84, 87

[56] References Cited

U.S. PATENT DOCUMENTS

| | | | |
|---|---|---|---|
| 3,285,168 | 11/1966 | Childress | 101/150 |
| 3,738,266 | 6/1973 | Maeda et al. | 101/150 |
| 3,776,630 | 12/1973 | Ohno et al. | 101/129 |
| 3,934,503 | 1/1976 | Kinney et al. | 101/128.4 |
| 4,091,727 | 5/1978 | Hasegawa et al. | 101/128.21 |
| 4,212,393 | 7/1980 | Lenkoff | 206/575 |
| 4,402,262 | 9/1983 | Handforth | 101/129 |

FOREIGN PATENT DOCUMENTS

| | | | |
|---|---|---|---|
| 46803 | 4/1978 | Japan | 101/395 |

OTHER PUBLICATIONS

Instructions on product currently being sold by: Riso Kagaku Corp. C.P.O. Box 1242 2–20–15 Shimbashi, Minato–Ku Tokyo, Japan.

*Primary Examiner*—Stephen Funk
*Attorney, Agent, or Firm*—Kalish & Gilster

[57] ABSTRACT

A printing plate with a mesh material, a removable substrate, a substrate, and a paper backing on said substrate. The mesh material has interstices and has first and second surfaces. The substrate is adhered to one of the first and second surfaces of the mesh material and forms a well defined at its bottom by the substrate and at its sides by the interstices of the mesh material, wherein the well receives and stores pigment for printing. Multiple colors of pigment may be stored simultaneously within the wells of the printing plate, thereby enabling those multiple colors to be printed concurrently in a single printing pass operation.

8 Claims, 5 Drawing Sheets

PRINTING PLATE WITH A MESH LAYER FORMING PIGMENT STORING WELLS

BACKGROUND OF THE INVENTION

1. Field of the Invention

The present invention relates to printing multiple-color copies in a single printing pass. More specifically, the present invention relates to a printing plate capable of producing high resolution, multiple-color copies in a single printing operation pass.

2. Related Art

Currently, printing in multiple colors requires a separate stencil for each color which is produced manually or by a photoetching process. A stencil is a thin sheet or plate in which a pattern of cut-outs or openings are treated to allow an applied pigment to pass through, bounded by the edges of the openings, thereby allowing the pigment to penetrate to a surface beneath.

It should be noted that the term "pigment" is used hereinbelow to indicate paint, ink, crayons, etc. and encompasses the use of some form of pigment in a carrier or pigment in a carrier vehicle.

After a separate stencil is formed for each desired color, a first stencil is placed on the printing machine wherein fluid pigment of a single desired color is applied and a squeegee is dragged across both the stencil and the pigment. As only one color may be applied per pass of the squeegee and per stencil, the first stencil must be replaced with a second stencil and a second pass of the squeegee is required to print the second color. As a result, high volume printing operations have utilized massive printing machines having multiple printing heads, with each printing head being responsible for applying one color. These machines operate by having either the printing heads revolve around the work pieces, or the work pieces revolve around the multiple printing heads.

Certain disadvantages associated with the conventional method of screen printing include that multiple color screen printing currently requires multiple etched stencils accomplished generally by a photoetching or a manual process. The photoetching process requires additional expense both in terms of equipment and in labor.

The conventional printing process also requires the use of pigment which is in fluid form on a stencil. This is disadvantageous in that it often results in pigment which escapes the confines of the screen printing stencil, resulting in additional expense with respect to loss of pigment and additional cleanup costs.

The current printing process also carries the disadvantage of requiring the pigment supply to be applied nearly simultaneously with the printing operation, increasing the complexity of the printing operation and attendant concerns.

A further disadvantage of the existing state of technology is that no screen printing operation currently provides for high resolution multiple-color copies in a single printing pass.

Accordingly, the foregoing disadvantages greatly limit the public's ability to enjoy multiple color copies by practical barriers relating to space, cost, and cleanup.

SUMMARY OF THE INVENTION

It is in view of the above problems that the present invention was developed. The invention is an improved printing plate which allows high resolution, single pass, multi-color printing utilizing a dry pigment source. The invention actually eliminates the use of a stencil in the printing process and therefore eliminates any photoetching or manual process associated with stencils. The present invention is a printing plate comprising "wells" which act as the pigment supply source at the time of printing. Because these wells are filled with dry pigment, the need for concurrent application of wet pigment onto a stencil during the printing process is negated. Further, as multiple colors may be stored in separate wells, multiple colors may be printed in a single printing pass.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
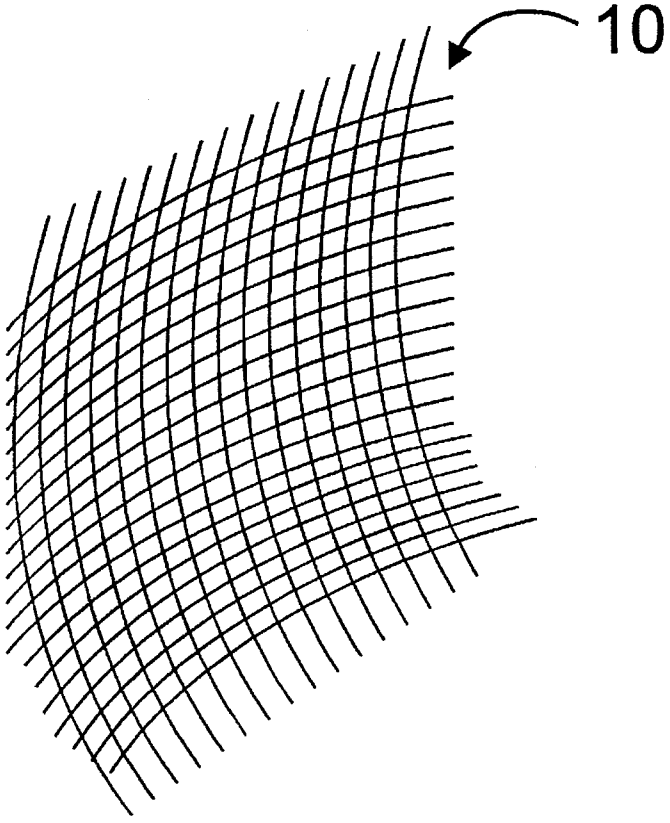
FIG. 1 illustrates standard silk screen type material which forms the basis of the present invention.

Referring to the accompanying drawings in which like reference numbers indicate like elements, FIG. 1 illustrates a mesh material 10 which forms the basis of the present invention. Mesh material 10 is, preferably, silkscreen or a silk-screen type material made from rayon or rayon-like material or any non-stretch fiber of open cell weave having a first and second surface.

Figure 2:
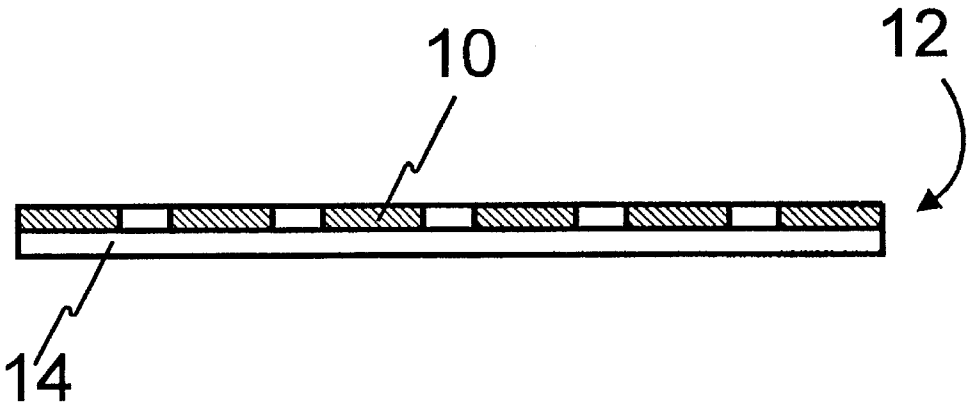
FIG. 2 illustrates the printing plate of the first embodiment of the present invention.

FIG. 2 illustrates the printing plate of the first embodiment of the present invention. Printing plate 12 comprises mesh material 10 and substrate 14 attached to one of the two surfaces of mesh material 10. Substrate 14 may be adhesively bonded to mesh material 10. It is preferable that substrate 14 be opaque or translucent. However, substrate 14 may be made from polymer, metal, or a liquid layer which is allowed to dry.

Figure 3:
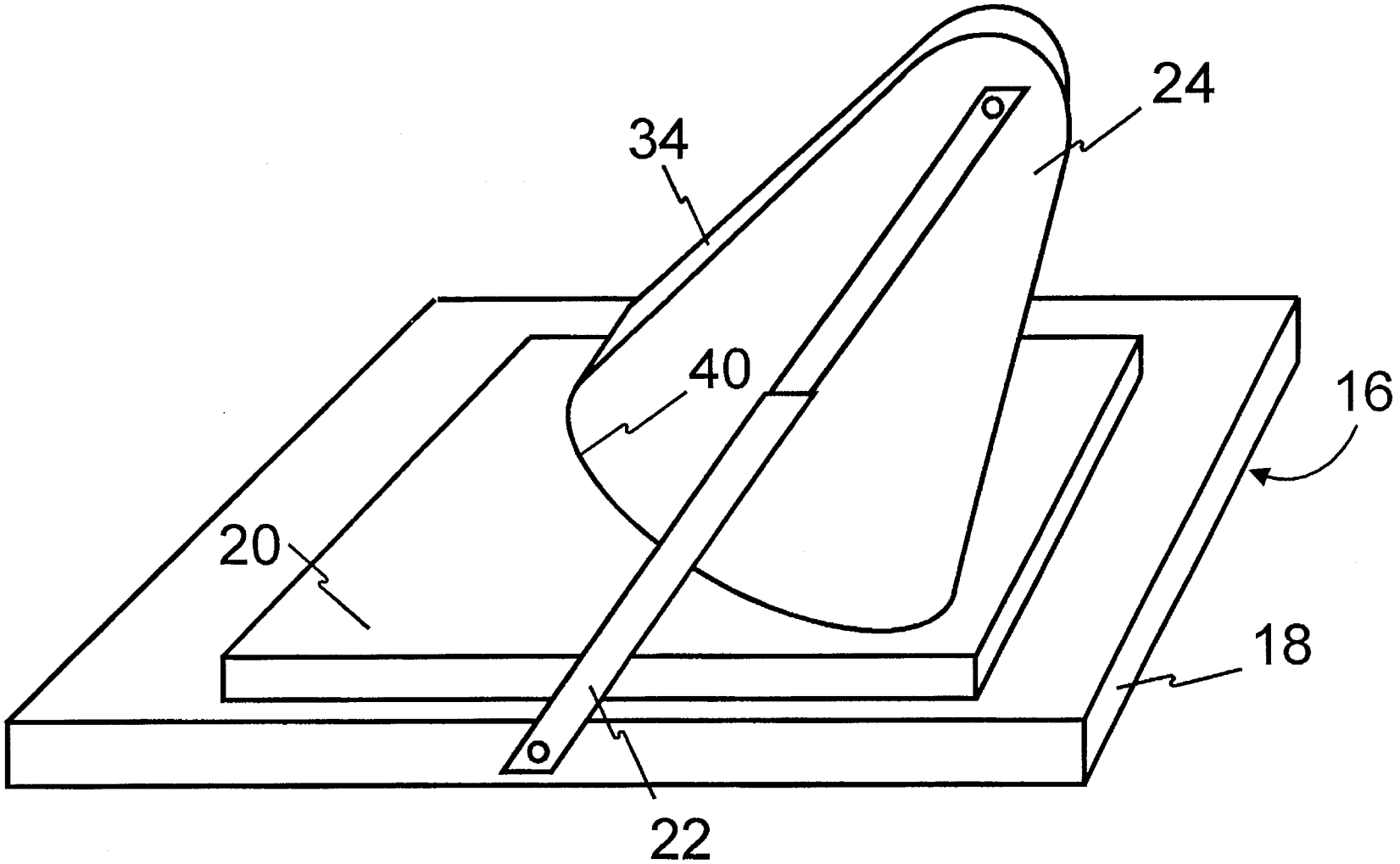
FIG. 3 illustrates one type of printing machine which may be used in conjunction with the first embodiment of the present invention to create multiple color copies in a single pass.
Figure 4:
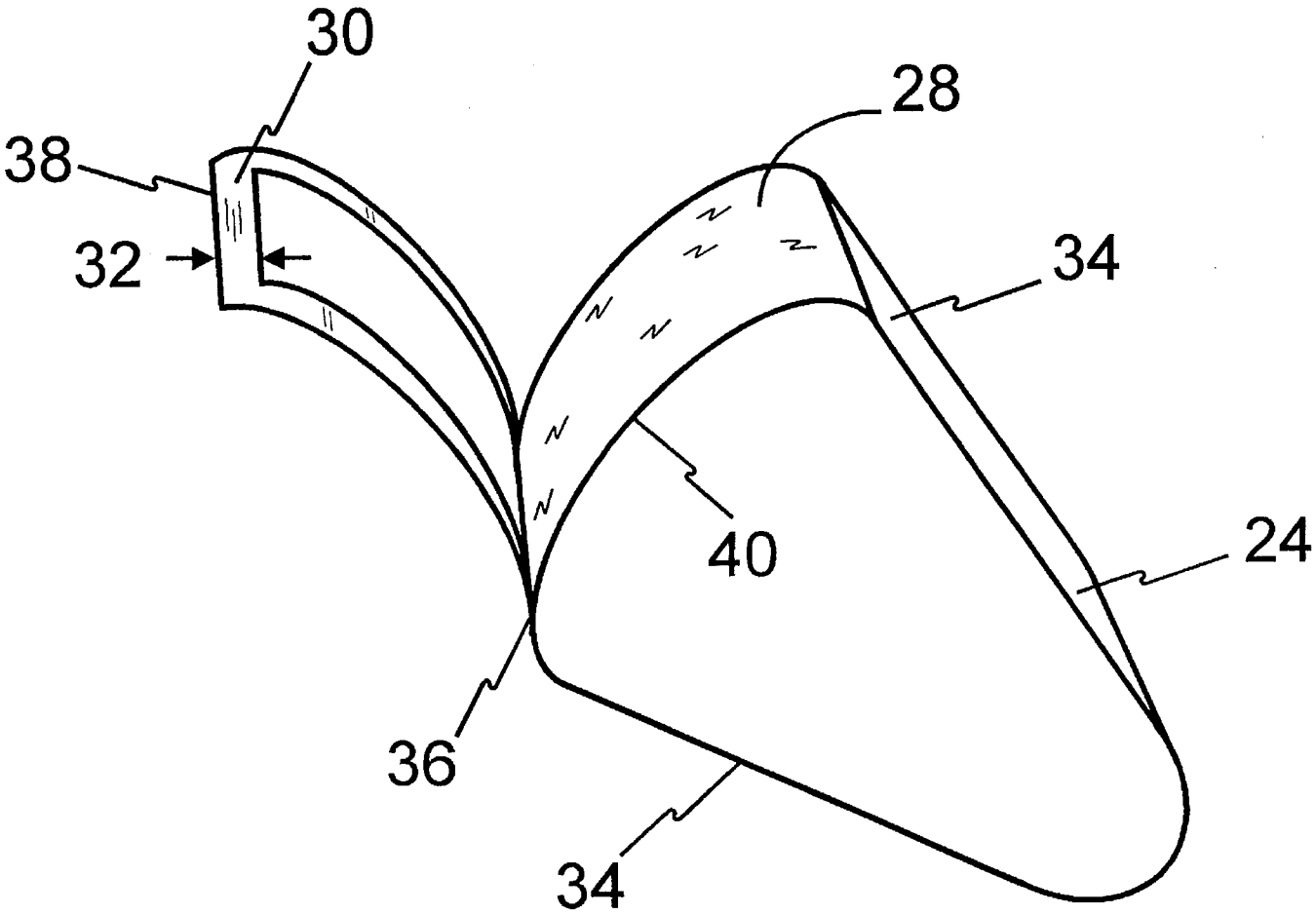
FIG. 4 illustrates in greater detail a printing element of FIG. 3.

In FIGS. 3 and 4, the operation of a printing process utilizing printing plate 12 of the present invention will be described. Printing machine of FIG. 3 is shown generally at 16. Printing machine 16 comprises base 18, midbase 20, rod 22, and printing rocker 24.

Printing rocker 24 has a non-skid surface shown generally at 28 and retainer 30. Retainer 30 is a border of thickness 32 of one-half of one inch. Retainer 30 is preferably of light weight, thin, flexible material. Non-skid surface 28 may be of a sponge type or a rubber-type material.

In use, a person may preferably utilize a pigment such as a non-toxic, water color paint which can be produced in crayon form to draw on printing plate 12, although any pigment which is soluble by a solvent may be; used. Specifically, pigment (not shown) is applied to mesh material 10 of printing plate 12. Multiple colors of pigment may be used concurrently upon printing plate 12. It is noted that the translucent or opaque quality of substrate 14 allows printing plate 12 to be placed on top of an existing drawing so that the drawing may be viewed through printing plate 12 and thereby traced with pigment.

Then, the applied pigment on printing plate 12 is allowed to dry for no more than four to five minutes. Alternatively, pigment is applied in its dry state via a soluble crayon.

Next, printing rocker 24 of printing machine 16 is manipulated to rest on its side 34. Retainer 30 is fixed at fixed end 36 to printing rocker 34. Free end 38 of retainer 30 is gently pulled away from printing rocker 24. Then, printing plate 12 is inserted between non-skid surface 28 and retainer 30 such that substrate 14 comes into contact with non-skid surface 28 and mesh material 10 containing the pigment is adjacent retainer 30.

Next, a sheet of regular paper (not shown) comparable in dimension to non-skid surface 28 is dampened with a sponge saturated with pigment solvent. In the case where non-toxic, water soluble paint is used, the pigment solvent is water. The paper (not shown) dampened with solvent is then placed on midbase 20 in readiness for the printing pass operation. Printing rocker 24 is positioned with its foremost edge of non-skid surface 28 directly adjacent to the edge of the dampened paper on midbase 20. Printing rocker 24 is then rocked forward to traverse the circumference of arc 40 a single time, thereby forcing contact between the paper and mesh material 10 of printing plate 12.

The direct contact between the dampened paper and printing plate 12 moistens the dried pigment contained in the wells of mesh material 10. Accordingly, the pigment flows from mesh material 10 onto the damp paper thereby resulting in the deposit of multi-colored pigment onto the damp paper.

This process may be repeated for multiple copies. Printing rocker 24 may be rocked forward or backward in either direction along the circumference of arc 40. It is noted that multiple copies may be made consecutively from a single printing plate 12 prepared in accordance with the present invention.

As a practical matter, a kit may be assembled for the first embodiment of the present invention comprising a plurality of printing plates 12, a printing machine 16, a supply of paper (or a plurality of sheets of paper), a sponge, and a supply of pigment contained in bottle form if fluid and contained in crayon-type form if solid.

Printing plate 12 of the first embodiment of the present invention allows for multiple color copies to be created in a single printing pass operation. However, it should also be noted that printing plate 12 of the first embodiment of the present invention only provides for reverse-type copies. Therefore,, any type of written message applied to printing plate 12 results in a reversed orientation (and thus not easily readable) on the copy.

To correct this, FIGS. 5*a*, 5*b*, 5*c*, and 6 illustrate the second embodiment of the present invention. Printing plate 44 of the second embodiment of the present invention allows for multiple color copies to be printed in a single pass but without reversal of language or image.

Printing plate 44 of the second embodiment of the present invention comprises mesh material 10 adhesively attached at one end to substrate 46. Substrate is preferably made from polymer, metal, or the like. Preferably, substrate 46 is opaque or translucent. Substrate 46 is adhesively attached to paper backing 48. One surface of mesh material 10 is adhesively attached to removable substrate 50.

Figure 5A:
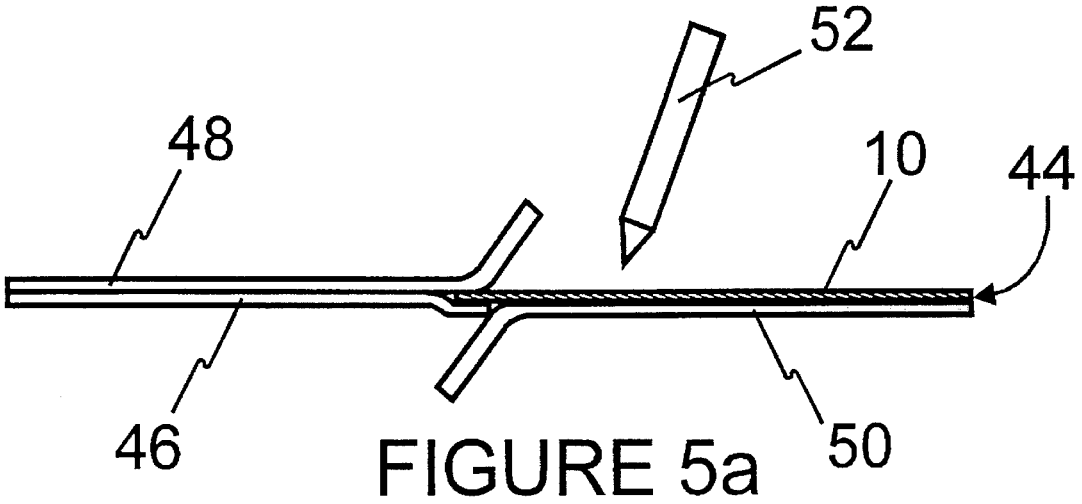
FIG. 5*a* illustrates the printing plate of the second embodiment of the present invention.
Figure 5B:
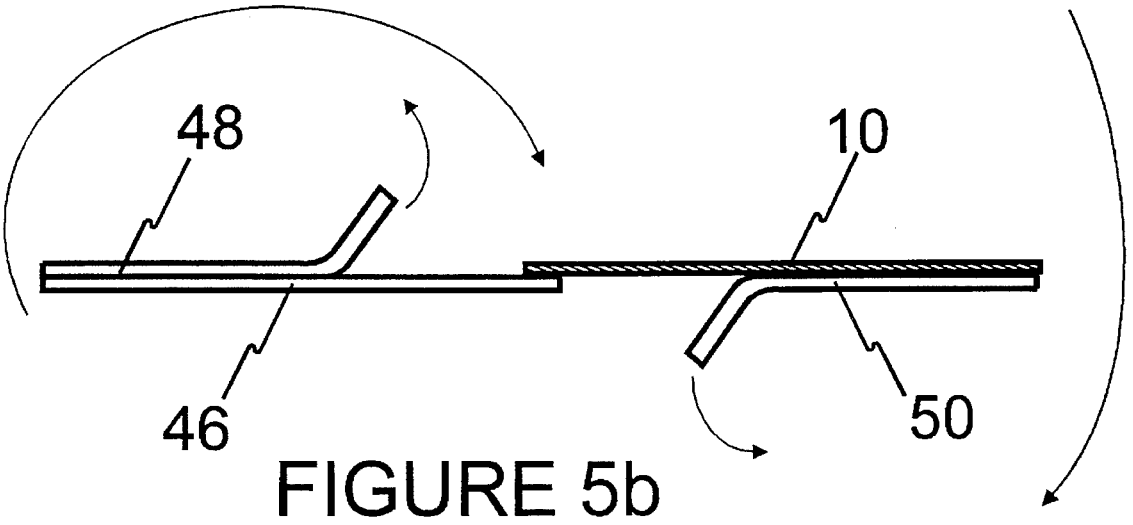
FIG. 5*b* illustrates the operation and preparation of the printing plate of the second embodiment of the present invention.
Figure 5C:
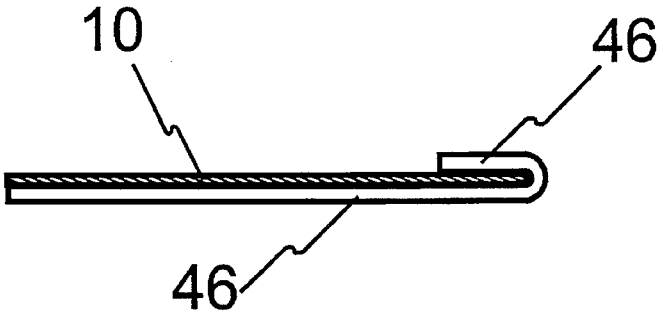
FIG. 5*c* illustrates the final, pre-printing state of the printing plate of the second embodiment of the present invention.

In use, a dry crayon 52 applies pigment to mesh material 10. By way of example but not limitation, one type of crayon which has been found to work well is of the non-toxic, water soluble type. Next, as shown in FIG. 5*b*, paper backing 48 and removable substrate 50 are stripped from their respective adherends. Substrate 46 retains its adhesive surface which it shared with paper backing 48. Substrate 46 is pivoted at the end of mesh material 10 to recontact and adhere to mesh material 10 as shown in FIG. 5*c*. Substrate 46 prevents the dry pigment from crayon 52 from escaping mesh material 10 as a result of capillary action.

Figure 6:
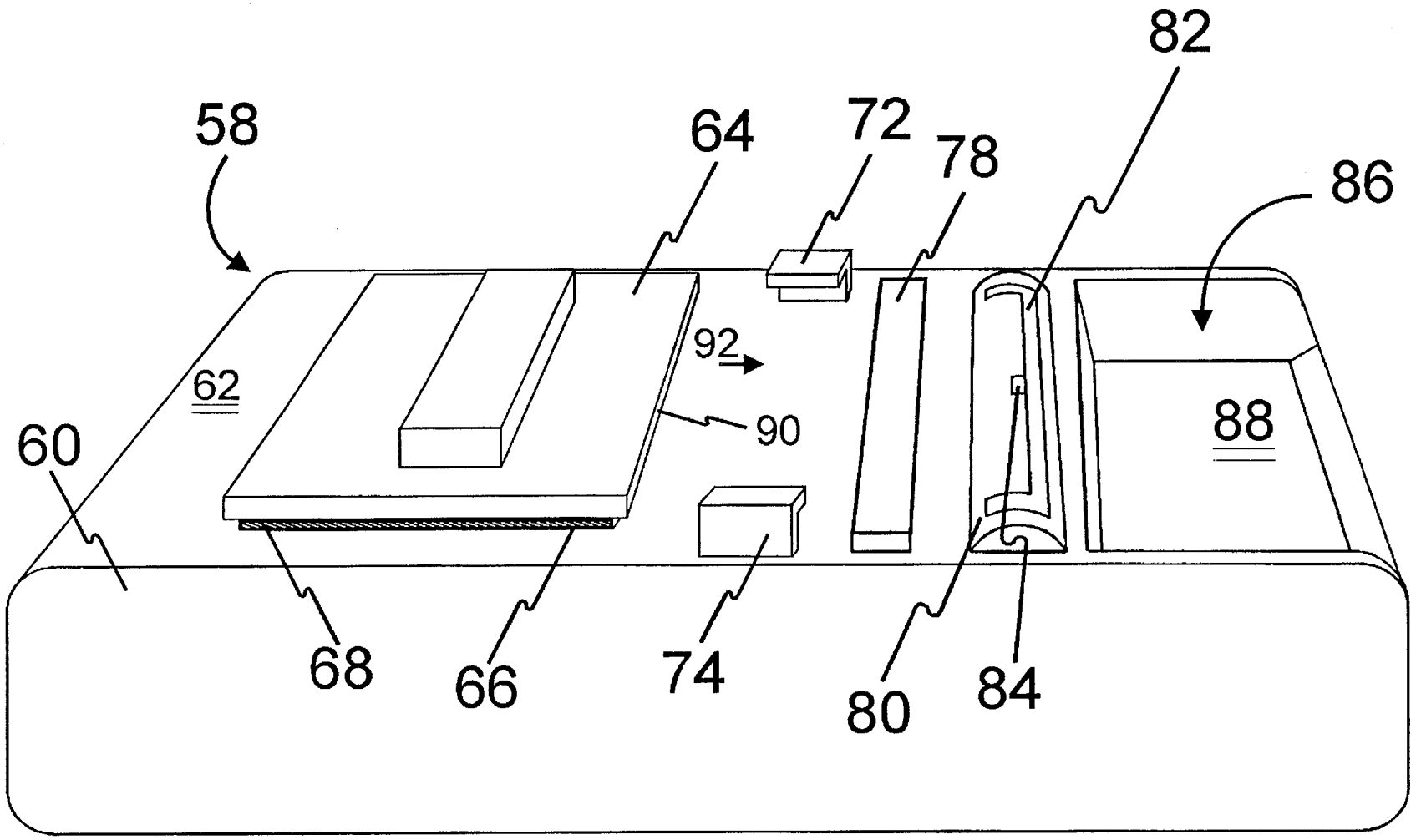
FIG. 6 illustrates a printing press which facilitates use of the printing plate of the second embodiment of the present invention.

In FIG. 6, a printing machine shown generally at 58 is compatible with either printing plate 12 or 44 of the second embodiment of the present invention.

Printing machine 58 comprises housing 60, upper surface 62, driver element 64 having sponge portion 66 defining surface portion 68, left and right slotted guides, 72 and 74, respectively, wetting strip 78, drum 80, retainer 82, tape element 84, sunken portion shown generally at 86, and lower surface 88.

To prepare printing machine 58 for operation, wetting strip 78 is saturated with pigment solvent. In the event a non-toxic, water soluble pigment is initially applied, an ideal solvent is water. Then, printing plate 44 is secured between drum 80 and retainer 82. Preferably, retainer 82 may be made from any thin, flexible sheet-like material, although other materials may be used to accomplish the function of retaining. To assist in retaining printing plate 44 between retainer 82 and drum 80, tape element 84 may be used to tape retainer 82 to printing plate 44. With respect to placement of printing plate 44, care should be taken to insure that substrate 48 comes in direct contact with the outer surface of drum 80.

A piece of plain paper is then secured to sponge portion 66 traversing the entirety of surface portion 68. The inventor has found that using paper having a length longer than the surface portion 68 of driver element 64 is desirable in that the additional length of paper may be used to lip around front edge 90 of driver element 64.

Driver dement is then directed in the direction of arrow 92 so that driver element 64 passes underneath the top rail of left and fight slotted guides 72 and 74. As a result of this forward motion, the paper is dampened by wetting strip 78 just prior to forcing contact between the paper and mesh material 10 of printing plate 44 on drum 80. As the paper from driver element 64 traverses drum 80, drum 80 rotates to allow full contact between the length of printing plate 44 and the paper.

After a single pass is completed, the printer may release paper from driver element 64 into sunken portion 86. More specifically, the copy may dry in lower surface 88.

It should be noted that multiple copies have been made from a single printing plate 44 of the second embodiment of the present invention.

Similar to the first embodiment of the present invention, a kit may be assembled for the second embodiment of the present invention comprising a plurality of printing plates 44, a printing machine 58, a supply of paper (or a plurality of sheets of paper), a bottle (not shown) containing pigment solvent for saturating wetting strip 76, and a supply of pigment contained in bottle form if fluid and contained in crayon-type form if solid.

In sum, both embodiments of the printing plate 12 and 44 of the present invention rely on the general inventive concept that pigment, is stored in wells defined by the interstices present in mesh material 10 and by substrate 14 and 46. Without the presence of substrate 14 or 46 to form the bottom of the well, capillary action would prevent pigment from being stored within the wells. Further, multiple colors of pigment may be stored simultaneously within printing plate 12 or 44, thereby enabling those multiple colors to be printed concurrently in a single printing pass operation.

In view of the foregoing, it will be seen that the disadvantages of the prior art are corrected and other advantages are attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, a mesh material 10 which is thicker than ordinary silkscreen may be utilized to increase the "holding capacity" of the wells created by printing plate 12 and 44. In a further example, it is noted that the invention is not limited in coverage to the use of a non-toxic, water soluble pigment. Instead, the pigment may be any that is capable of becoming soluble in a solvent. Thus, the breadth and scope of the present invention should not be limited by any of the above-described exemplary embodiments, but should be defined only in accordance with the following claims appended hereto and their equivalents.

What is claimed is:

1. A printing plate comprising:

a mesh material having first and second surfaces and having first and second ends;

a removable substrate attached to one of said first and second surfaces;

a substrate attached to one of said first and second ends of said mesh material; and a paper backing removably attached to said substrate.

2. A printing plate as set forth in claim 1, wherein said mesh material is made from any non-stretch fiber of open-cell weave.

3. A printing plate as set forth in claim 1, wherein said mesh material is made from rayon.

4. A printing plate as set forth in claim 1, wherein said removable substrate is made from polymer material.

5. A printing plate as set forth in claim 1, further comprising adhesive, wherein said removable substrate is adhered to one of said first and second surfaces of said mesh material by said adhesive.

6. A printing plate as set forth in claim 1, further comprising adhesive, wherein said substrate is attached to one of said first and second ends of said mesh material with said adhesive.

7. A printing plate as set forth in claim 1, further comprising adhesive, wherein said paper backing is attached to said substrate with said adhesive.

8. A printing plate as set forth in claim 1, further comprising pigment disposed on said mesh material.

* * * * *